US007434917B2

(12) United States Patent
Iijima

(10) Patent No.: US 7,434,917 B2
(45) Date of Patent: Oct. 14, 2008

(54) INK JET RECORDING HEAD HAVING TEMPERATURE CONTROL HEATERS AND NOZZLE ARRAYS OF DIFFERING DISCHARGE AMOUNTS

(75) Inventor: Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 11/348,358

(22) Filed: Feb. 7, 2006

(65) Prior Publication Data

US 2006/0181571 A1 Aug. 17, 2006

(30) Foreign Application Priority Data

Feb. 17, 2005 (JP) ..... 2005-040591

(51) Int. Cl.
*B41J 2/05* (2006.01)

(52) U.S. Cl. ..... 347/62; 347/15

(58) Field of Classification Search ..... 347/14, 347/17, 20, 40, 43, 44, 56–65, 67, 15
See application file for complete search history.

(56) References Cited

U.S. PATENT DOCUMENTS 6,527,367 B2 * 3/2003 Yabe ..... 347/43
6,591,500 B1 7/2003 Suzuki et al. ..... 29/890.1
6,733,117 B2 5/2004 Tajima et al. ..... 347/87
6,799,841 B2 10/2004 Iri et al. ..... 347/85
6,830,317 B2 * 12/2004 Tsuchii et al. ..... 347/56
2006/0181578 A1 8/2006 Iijima ..... 347/62

FOREIGN PATENT DOCUMENTS

JP 7-52387 2/1995

* cited by examiner

*Primary Examiner*—Juanita D Stephens
(74) *Attorney, Agent, or Firm*—Fitzpatrick, Cella, Harper & Scinto

(57) ABSTRACT

In an ink jet recording head which can discharge ink droplets having different discharge amounts, stabilization of the ink discharge amount is efficiently achieved without upsizing and cost increase. In the ink jet recording head of the invention, three ink supply ports are provided in a recording element substrate. For a cyan ink discharge unit and a magenta ink discharge unit which are located on both side portions of a recording element substrate, a nozzle array having a large ink discharge amount and a nozzle array having a small ink discharge amount are provided across the ink supply port, and a temperature control sub-heater is arranged near the nozzle array having the small ink discharge amount.

4 Claims, 7 Drawing Sheets

INK JET RECORDING HEAD HAVING TEMPERATURE CONTROL HEATERS AND NOZZLE ARRAYS OF DIFFERING DISCHARGE AMOUNTS

BACKGROUND OF THE INVENTION

1. Field of the Invention

The present invention relates to an ink jet recording head which discharges ink to perform recording and an ink jet recording apparatus which is equipped with the ink jet recording head.

2. Related Background Art

The ink jet recording apparatus equipped with the ink jet recording head is configured to record an image on a recording medium (material onto which the recording is performed) such as paper, plastic, or an OHP (Overhead Projector) sheet based on supplied recording information. As used herein, the term of "image" shall include not only images, such as characters, symbols, and graphics, which have individual meanings but also images, such as patterns and solid coloring, which do not have the meanings. The terms of "recording" and "image formation" shall mean the whole of the image forming operation.

In the configuration of the ink jet recording apparatus, the ink supplied to the ink jet recording head is discharged toward the recording medium such as recording paper by heating or vibration, and thereby the image is recorded on the recording medium. An ink droplet which is discharged from the ink jet recording head and deposited on the recording medium spreads on the recording medium to form a dot. The image which is of an aggregation of the dots is formed on the recording medium. An area of one dot depends largely on a size of the ink droplet, i.e., an ink discharge amount. Therefore, in order to form the fine image by the ink jet method, it is necessary to control the ink discharge amount.

The ink discharge amount depends largely on an ink temperature and a recording head temperature, and the discharge amount is increased or decreased according to a fluctuation in temperature. Therefore, it is necessary to manage the temperatures of the ink jet recording head and the ink. Particularly, in a low-temperature environment, viscous resistance is increased in an ink discharge nozzle (hereinafter referred to as "nozzle") of the ink jet recording head with increasing ink viscosity, which significantly decreases the ink discharge amount.

Therefore, Japanese Patent Laid-Open No. H07-52387 discloses a configuration in which a temperature-retention heat generating element (hereinafter referred to as "temperature control heater" or "sub-heater") is provided in the ink jet recording head. In the ink jet recording head disclosed in Japanese Patent Laid-Open No. H7-52387, in the low-temperature environment, the sub-heater is driven to increase the temperatures of the ink jet recording head and the ink, and stabilization of the ink discharge amount is achieved.

Recently, in tendency of the ink jet recording apparatus, the ink droplet discharged from the ink jet recording head is finely formed as much as possible in order to realize high-quality recording equivalent to a photograph. Therefore, there is another problem that enhanced speed of high-quality recording is required.

In order to achieve both the high-quality image and the high-speed printing, there is known a technology in which the image is formed by combining dots having different droplet sizes (different liquid amounts). This enables the-dots having different diameters to be arranged in the image, and the image can be formed by the relatively small droplets in a portion where granularity is low. Further, this method enables the wide area to be efficiently filled with the smaller number of ink droplets using the relatively large ink droplets. Therefore, high-speed and high-quality image can be formed.

In the ink jet recording head which discharges the fine ink droplet, because an aperture area of the ink discharge port at a front end of the nozzle tends to be decreased to increase the viscous resistance of the nozzle, when the temperature falls, there is a fear that the decrease in ink discharge amount occurs in a short time in order to perform the temperature-retention control at high response to stabilize the ink discharge amount, it is effective that many sub-heaters, are installed. However, in this method, a substrate area where the sub-heaters are provided is enlarged. As a result, the problem of production cost increase is generated while upsizing of the whole of the ink jet recording head is caused.

SUMMARY OF THE INVENTION

In view of the foregoing, an object of the invention is to provide an ink jet recording head which efficiently stabilizes the ink discharge amount without upsizing and cost increase in the ink jet recording head which can discharge the ink droplets having the different discharge amounts. Another object of the invention is to provide an ink jet recording apparatus equipped with the ink jet recording head.

In order to achieve the above objects, an ink jet recording head of the invention includes a first nozzle array which discharges a predetermined ink amount; a second nozzle array which discharges ink having a discharge amount smaller than a discharge amount of the ink discharged from the first nozzle array; and an element substrate which includes a first heat generating resistance element array, a second heat generating resistance element array, and a temperature control heater, the first heat generating resistance element array corresponding to the first nozzle array and the second nozzle array, wherein a distance between the temperature control heater and the second heat generating resistance element array is shorter than a distance between the temperature control heater and the first heat generating resistance element array.

Further, in order to achieve the above objects, an ink jet recording apparatus of the invention includes a conveying mechanism which conveys a recording medium; and a carriage which moves the ink jet recording head in a direction intersecting a conveying direction of the recording medium, wherein the ink jet recording apparatus further comprises a control portion which uses the temperature control heater to perform temperature control.

According to the invention, the temperature retention can be controlled with high response in the nozzle array having the small discharge amount and the surroundings thereof, and the significant decrease in ink discharge amount caused by the increase in ink viscosity can be avoided without increasing the number of sub-heaters, so that the high-quality recording can stably be realized. In start-up of the recording operation, a warm-up time can be shortened to improve the speed of first print, so that the improvement of the total recording speed can be achieved. Further, the upsizing and the cost increase are never generated in the ink jet recording head.

DESCRIPTION OF THE PREFERRED EMBODIMENTS

Preferred embodiments of the invention will be described below with reference to the accompanying drawings.

First Embodiment

Figure 1A:
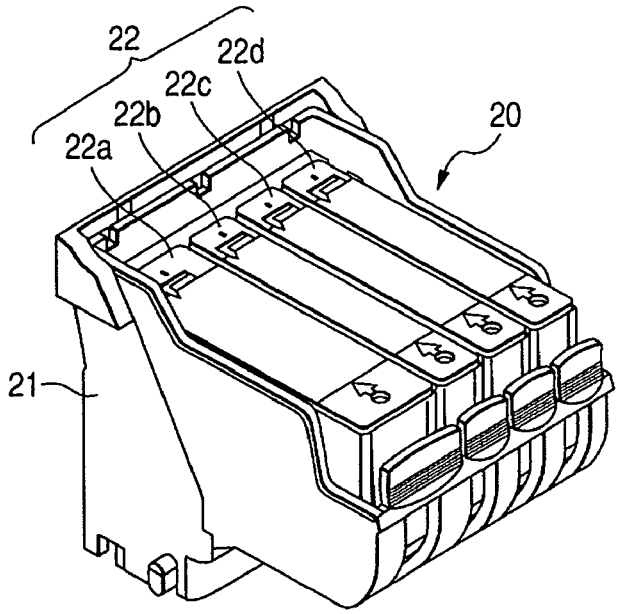
FIG. 1A is a perspective view showing a configuration of an ink jet recording head cartridge including an ink jet recording head according to a first embodiment of the invention.
Figure 1B:
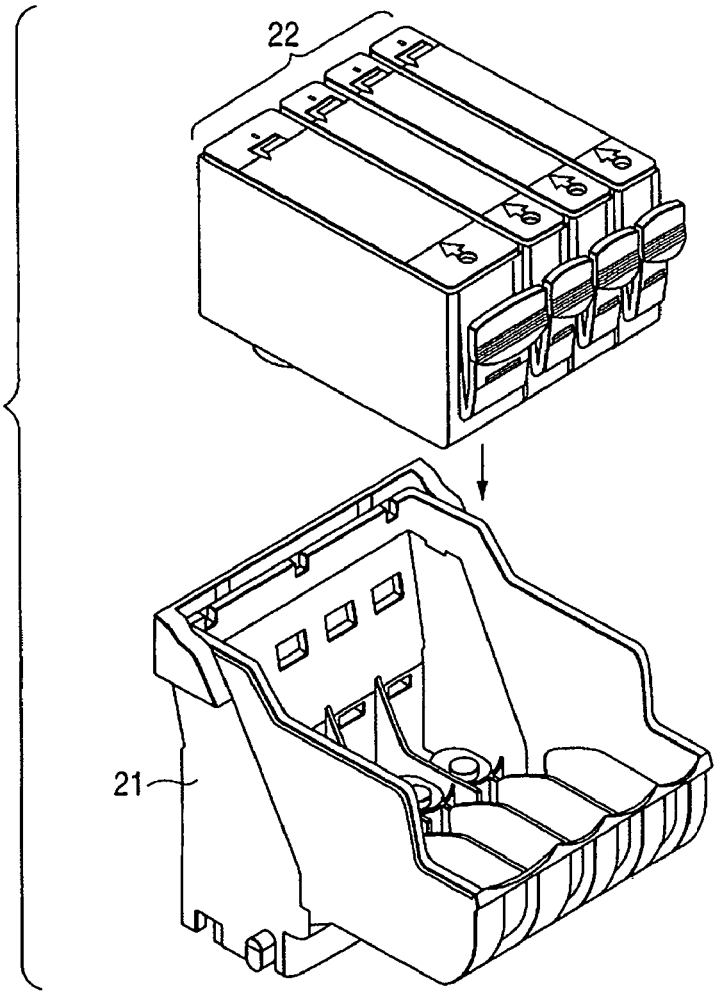
FIG. 1B is an exploded perspective view of the ink jet recording head cartridge.

FIGS. 1A to 6 are views explaining a configuration of an ink jet recording head according to a first embodiment of the invention. As shown in FIGS. 1A and 1B, an ink jet recording head 21 of the first embodiment is a component constituting an ink jet recording head cartridge 20. The ink jet recording head cartridge 20 includes the ink jet recording head 21 and an ink tank 22 is detachably provided in the ink jet recording head 21. The ink jet recording head 21 discharges the ink, supplied from the ink tank 22, from ink discharge ports 15 (see FIG. 4) according to recording information transmitted from a control portion 1 (see FIG. 6).

The ink jet recording head cartridge 20 is positioned by positioning means (not shown) with respect to a carriage 2 (see FIG. 6) mounted on an ink jet recording apparatus main body. The ink jet recording head cartridge 20 is electrically connected to the carriage 2 by electric contacts, and the ink jet recording head cartridge 20 is detachably supported by the carriage 2. The ink tank 22 of the first embodiment includes an ink tank 22*a* for black ink, an ink tank 22*b* for cyan ink, an ink tank 22*c* for magenta ink, and an ink tank 22*d* for yellow ink. Because each of the ink tanks 22*a* to 22*d* is independently detachable to a portion (see FIG. 3) where a seal rubber 402 is provided in the ink jet recording head 21, running cost of the recording can be decreased in the ink jet recording apparatus.

The ink jet recording head 21 has plural ink channels (not shown), and an electrothermal conversion element 50 (recording element, see FIGS. 4 and 6) which creates thermal energy for generating film boiling in the ink is arranged in each ink channel. The ink jet recording head 21 generates the heat by selectively driving any one of the plural electrothermal conversion elements 50 according to the image information supplied as an electric signal from the control portion 1, the ink jet recording head 21 discharges the ink by the film boiling, and thereby the image recording is performed. The ink jet recording head 21 is the so-called side shooter type ink jet recording head in which the ink droplet is discharged from an ink discharge port 15 piercing through a plate surface of the substrate in which the ink channel is formed.

Figure 2:
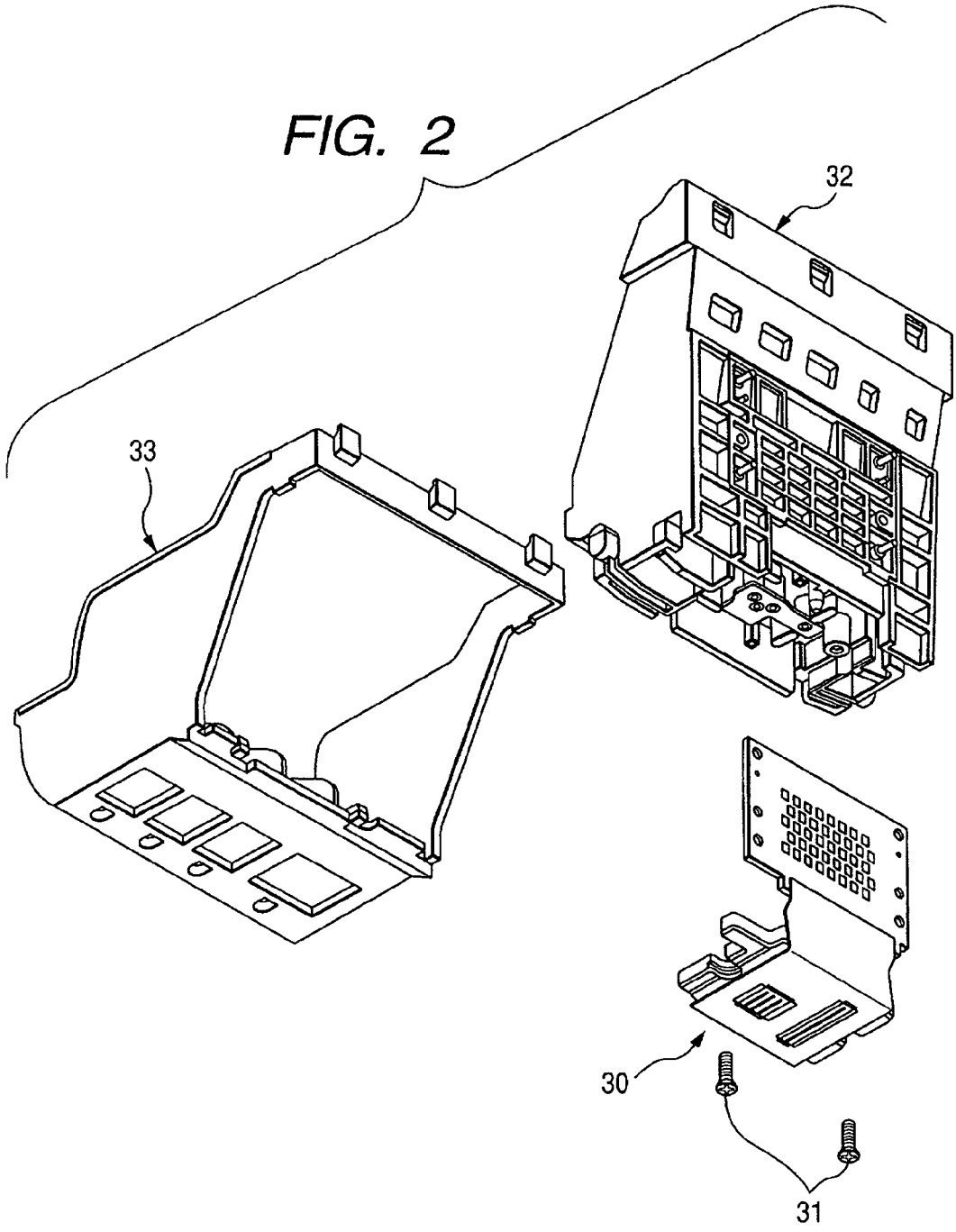
FIG. 2 is an exploded perspective view showing a configuration of the ink jet recording head shown in FIGS. 1A and 1B.

As shown in the exploded perspective view of FIG. 2, the ink jet recording head 21 includes a recording element unit 30, an ink supply unit 32, and a tank holder 33. As shown in the exploded perspective view of FIG. 31 in addition to a first black-ink recording element substrate 410 and a second color-ink recording element substrate 409, the recording element unit 30 includes a firstplate (first support member) 406, an electric wiring tape (flexible wiring board) 412, an electric contact substrate 411, and a second plate (second support member) 408.

The ink supply unit 32 includes an ink supply member 403, a flow path forming member 404, joint rubber (seal member) 405, a filter 401, and a seal rubber 402.

Among the components of the ink jet recording head 21, the second color ink recording element substrate 409 which is of the member having main features of the invention will be described in detail.

Figure 4:
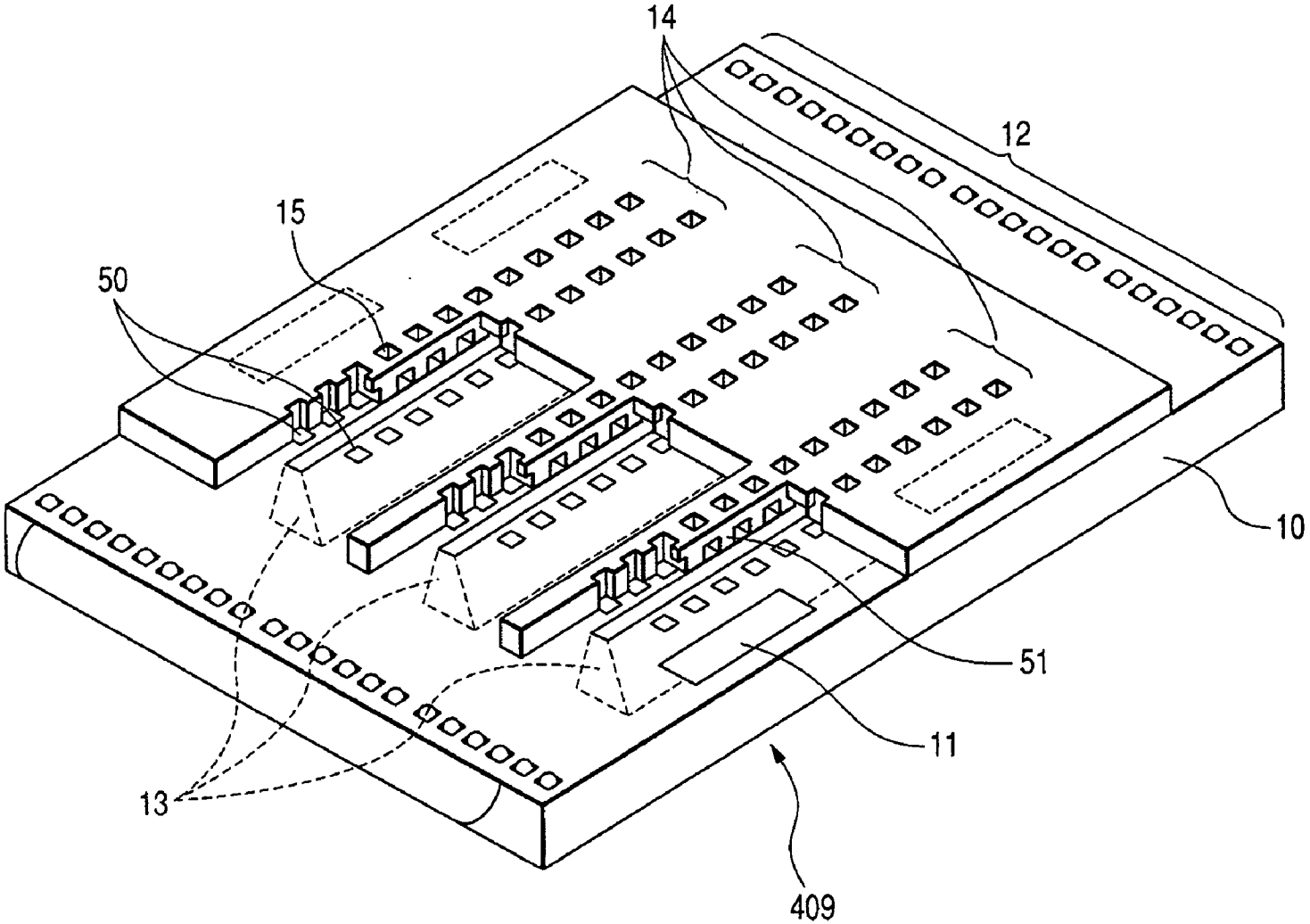
FIG. 4 is a perspective view showing a second recording element substrate of the ink jet recording head shown in FIG. 3.

FIG. 4 is a partially exploded perspective view for explaining the configuration of the second color-ink recording element substrate 409.

The second color-ink recording element substrate 409 is the recording element substrate which discharges three-color inks. The second color-ink recording element substrate 409 is formed by a silicon (Si) substrate 10 having a thickness ranging from 0.5 to 1 mm. The plural electrothermal conversion elements 50 which discharge the ink, the plural sub-heaters (temperature control heaters) 11 which perform the temperature retention of the Si substrate 10, and electric wiring which supplies electric power to each of the electrothermal conversion elements 50 are formed on one surface of the Si substrate 10 by a known film deposition technique.

The plural ink channels and the plural ink discharge ports 15 are formed corresponding to the electrothermal conversion elements 50 by a known photolithography technique. An ink supply port 13 which supplies the ink to the plural ink channels is formed in the Si substrate 10 so as to be opened to the opposite surface (backside) of the Si substrate 10. The three ink supply ports 13 are formed in parallel, and the electrothermal conversion element 50 and the ink discharge port 15 are formed across each of the ink supply ports 13.

Figure 3:
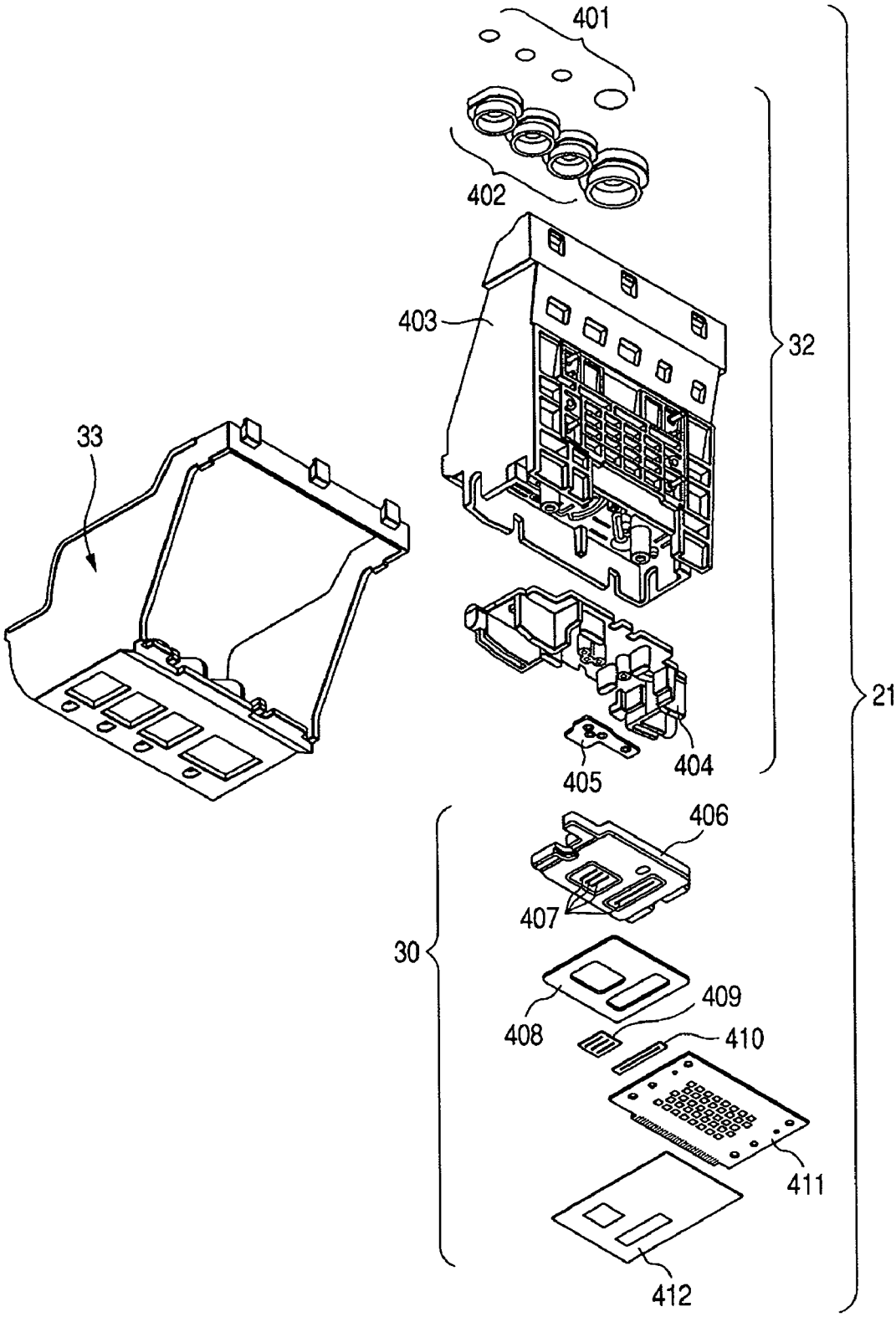
FIG. 3 is an exploded perspective view in which the ink jet recording head shown in FIG. 2 is further exploded.

As shown in FIG. 3, the second recording element substrate 409 is bonded and fixed to the first plate 406, and the ink supply port 13 is located at the fixed portion between the second recording element substrate 409 and the first plate 406. The second plate 408 having an opening is also bonded and fixed to the first plate 406, and the electric wiring tape 412 is held through the opening of the second plate 408 so as to be electrically connected to the recording element substrate 409. The electric wiring tape 412 transmits the electric signal for discharging the ink from the control portion 1 (see FIG. 6) to the second recording element substrate 409. The electric wiring tape 412 has electric wiring (not shown) corresponding to electric wiring of the second recording element substrate 409 and an external signal input terminal (not shown). The external signal input terminal is located in the electric wiring of the electric wiring tape 412 to receive the electric signal from the control portion 1. The external signal input terminal is positioned and fixed onto the backside of the ink supply member 403.

The ink supply port 13 is formed by the method such as isotropic etching utilizing Si crystal orientation and sand blasting. A row of electrothermal conversion elements 50 are formed across each of the ink supply ports 13 so as to be arranged in a zigzag manner. A combination of the rows of plural electrothermal conversion elements 50 and the plural ink discharge ports 15 is referred to as "nozzle array 14".

The electrothermal conversion element 50, the sub-heater 11, and the electric wiring which is made of Al and supplies the electric power to the electrothermal conversion element 50 and the sub-heater 11 are formed by the known film deposition technique. A row of electrodes 12 which supply the electric power to the electric wiring is arrayed on both outside regions of each row of the electrothermal conversion elements 50. The row of electrodes 12 is arrayed on both end portions of the second recording element substrate 409, i.e., substantially perpendicular to each row of the electrothermal conversion elements 50. A bump made of Au or the like is formed in the electrode 12 by an ultrasonic thermocompression bonding method. Ink channel walls 51 and the ink discharge ports 15 are formed on the Si substrate 10 by the known photolithography technique. The ink channel walls 51 and the ink discharge ports 15 form the ink channel corresponding to the electrothermal conversion element 50, and the ink channel walls 51 and the ink discharge ports 15 form the nozzle away 14. The ink channel walls 51 and the ink discharge ports 15 are made of a resin material. The ink discharge port 15 is provided in each ink channel while facing the electrothermal conversion element 50. Accordingly, the ink supplied from the ink supply port 13 into the ink channel is discharged from the ink discharge port 15 by pressure of a bubble which is generated by heat generation of the electrothermal conversion element 50.

The first black-ink recording element substrate 410 is formed in the same manner as the second color-ink recording element substrate 409. In the first element substrate, since only mono-color ink (black ink) is supplied, the one ink supply port 13 is used, and the row of the electrothermal conversion elements 50 and the row of the ink discharge ports 15 are formed across the ink supply port 13.

Figure 5:
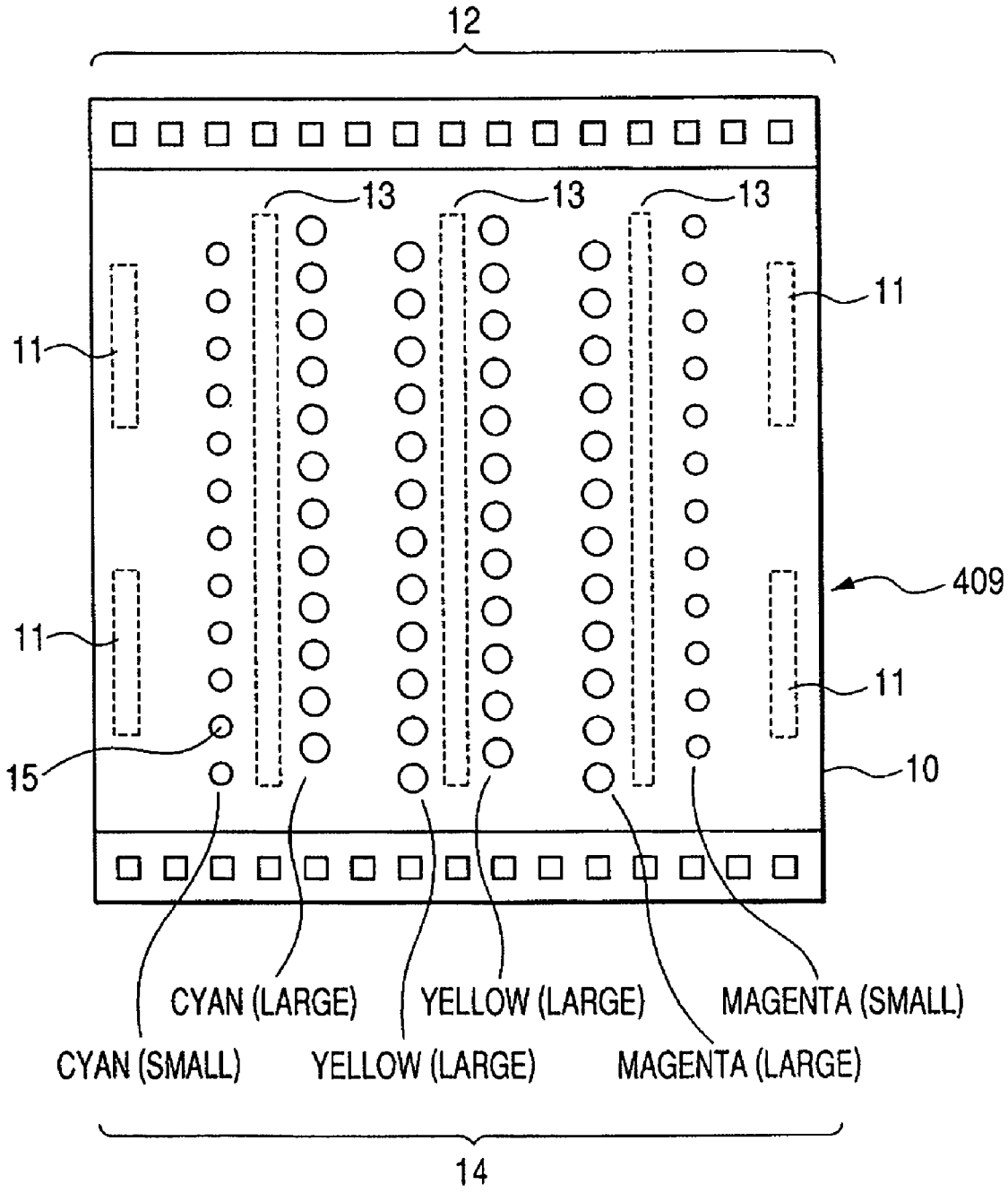
FIG. 5 is a plan view schematically showing a configuration of the second recording element substrate shown in FIG. 4.

The second color-ink recording element substrate 409, particularly a relationship between the nozzle away 14 and the sub-heater 11, will be described in detail. FIG. 5 is a plan view schematically for explaining the relationship between the nozzle array 14 and the sub-heater 11 in the second color-ink recording element substrate 409. The three ink supply ports 13 for the cyan color ink, the magenta color ink, and the yellow color ink are formed in parallel in the second recording element substrate 409. The electrothermal conversion element 50 and the ink discharge port 15 are formed across each of the ink supply ports 13.

In the color-ink recording element substrate 409 of the first embodiment, six nozzle arrays including two each of the cyan ink discharging nozzle arrays, the magenta ink discharging nozzle arrays, and the yellow ink discharging nozzle arrays are formed from one side of the substrate toward the other side. The two nozzle arrays of each color are arranged on opposite sides of one of the ink supply ports 13.

For the cyan ink and magenta ink discharge portions in the six rows of nozzle arrays 14, the nozzle array 14 having the large discharge amount and the nozzle array 14 having the small discharge amount are provided across the ink supply port 13. That is, in order to achieve both the high-quality image and the high-speed printing, the two nozzle arrays 14 having the different discharge amount for the same color are provided such that the image is formed by combining the dots formed by the droplets having the different sizes. The nozzle array 14 having the small discharge amount of ink droplet discharges the ink to form the image in the portion where the granularity is low. The small discharge amount of ink droplet preferably ranges from 1 to 5 pl, and the discharge amount of ink droplet is 3 pl in the first embodiment. The nozzle array 14 having the large discharge amount of ink droplet discharges the ink to form the image in the portion which is filled with the ink droplets. The large discharge amount of ink droplet preferably ranges from 5 to 15 pl, and the discharge amount of ink droplet is 10 pl in the first embodiment. The wide area can be efficiently filled with the smaller number of ink droplets by utilizing the ink discharged from the nozzle array 14 having the large discharge amount, and the image can be formed at high speed. Further, for the fine portion in the image, high-quality image can be formed by performing the image formation with the ink discharged from the nozzle array 14 having the small discharge amount. In the first embodiment, the nozzle arrays 14 having the small discharge amounts are arranged on the both side portions of the second recording element substrate 409.

On the other hand, for the yellow ink discharge portion, the two nozzle arrays 14 having the large discharge amounts are provided across the ink supply port 13 in the central portion of the second recording element substrate 409. Because the yellow ink is relatively low in color perception compared with the cyan ink and magenta ink, even the large yellow dot hardly has an influence on the granularity. Therefore, the ink droplet decreasing effect is small.

In the ink channel in which the ink discharge port 15 has the small diameter in order to decrease the ink discharge amount, a degree in which the ink discharge amount is significantly decreased becomes extremely large because the viscous resistance is increased in the nozzle in association with the increase in ink viscosity. For example, in the first embodiment, in the low-temperature environment of 15° C., while a time during which the ink cannot finally be discharged due to the increase in ink viscosity is at least five seconds for the nozzle array 14 having the large discharge amount, the time is only one to two seconds for the nozzle array 14 having the small discharge amount. Accordingly, in the low temperature, it is necessary that the viscous resistance in the nozzle be decreased to achieve the stabilization of the discharge amount by rapidly raising the temperature to decrease the ink viscosity in the nozzle array 14 having the small discharge amount and surroundings thereof. That is, it is necessary that the time necessary to raise the temperature be extremely short in the nozzle array 14 having the small discharge amount and surroundings thereof. When the temperature is efficiently and rapidly raised in the low temperature, not only the high-quality image recording can be performed by the stabilization of the discharge amount, but also the total recording speed can be improved by shortening the warm-up time to increase the speed of the first print (initial image formation after the start-up of the recording operation).

Because the ink supply port 13 is formed by opening the Si substrate 10 having good thermal conductivity, the heat transfer is obstructed by the ink supply port 13. Accordingly, in the nozzle away 14 which is located on the opposite side to the sub-heater 11 across the ink supply port 13, a time loss is generated until the temperature-retention effect appears to raise the temperature. In the first embodiment, as described above, the sub-heaters 11 are arranged on both side portions of the second recording element substrate 409 where the nozzle arrays 14 having the small discharge amounts are arranged, and the sub-heater 11 and the nozzle away 14 having the small discharge amount are arranged on the same side with respect to the ink supply port 13. In this case, because the wiring routing is relatively easily performed in the side portion of the second recording element substrate 409, layout of the electric wiring for connection with the sub-heater 11 is efficiently and easily performed.

Figure 6:
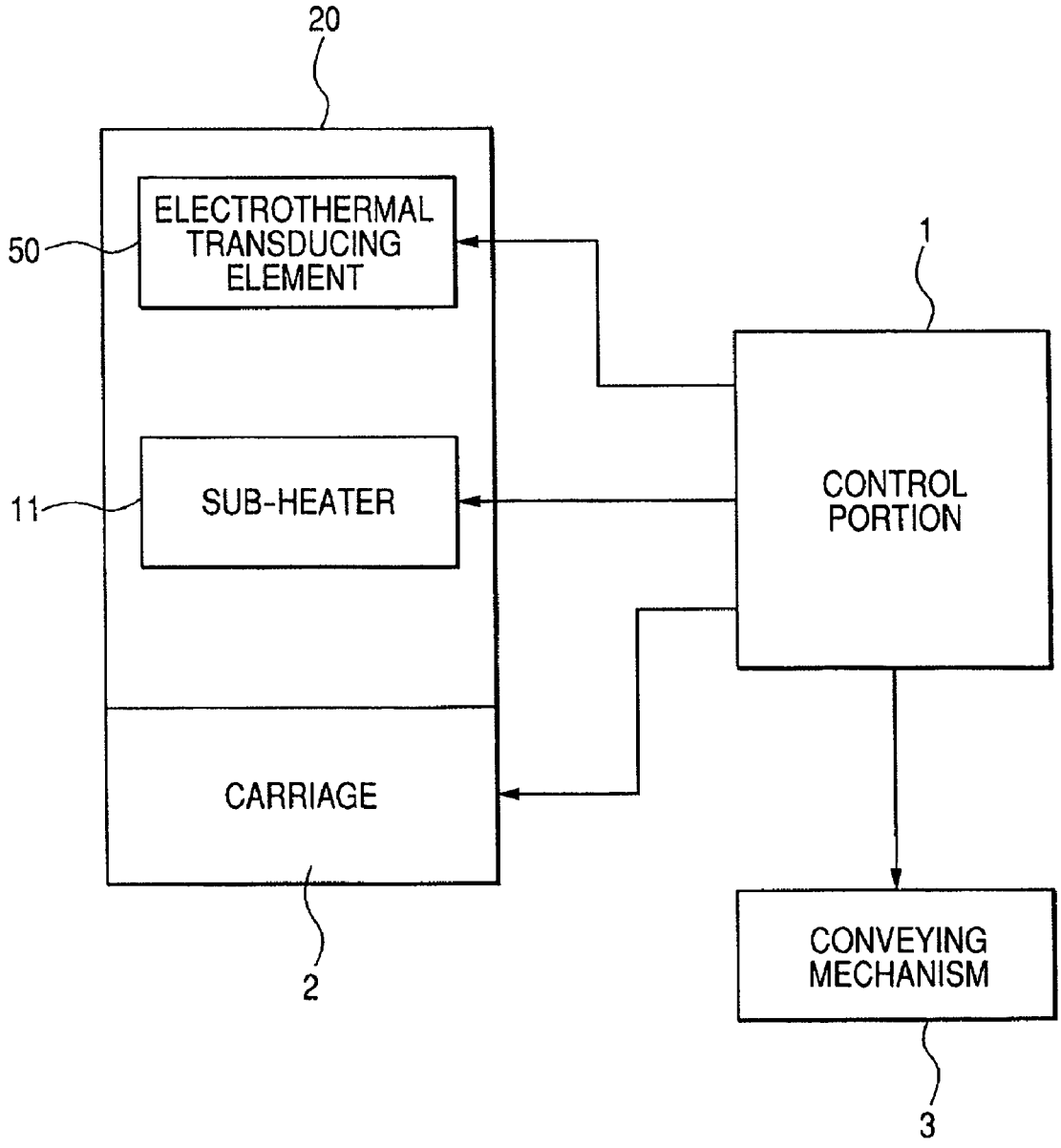
FIG. 6 is a block diagram schematically showing a basic configuration of an ink jet recording apparatus including the ink jet recording head of the invention.

FIG. 6 shows a schematic view of the ink jet recording apparatus including the ink jet recording head 21. In the recording operation with the ink jet recording apparatus shown in FIG. 6, the control portion 1 drives the carriage 2, the carriage 2 and the ink jet recording cartridge 20 including ink jet recording head 21 are moved (main scan) so as to traverse the recording medium (not shown) stopped at the recording start position. An electric drive signal is selectively supplied to the predetermined electrothermal conversion element 50 among the plural electrothermal conversion elements 50 at proper timing based on the information on the image to be formed, and the ink is discharged toward the recording medium to perform one-line image formation.

When the one-line image formation is completed, the control portion 1 drives the conveying mechanism 3 to move the recording medium by one-line pitch (sub-scanning). The main scan and the sub-scan are alternately repeated to form the image over the recording medium. When the temperature fall of the ink jet recording head 21 is detected by a sensor (not shown) or the like, the control portion 1 instantly drives the sub-heater 11 to rapidly raise the temperature. As described above, the temperature is particularly rapidly raised in the nozzle array 14 having the small discharge amount and surroundings thereof. Therefore, the increase in ink viscosity is suppressed to achieve the stabilization of the discharge amount.

Thus, according to the first embodiment, in the ink jet recording head including the nozzle arrays 14 having the different discharge amounts, the sub-heater 11 is arranged near the nozzle array 14 having the small discharge amount. Therefore, even if the performance and the number of sub-heaters 11 are similar to those of the conventional sub-heater 11, the temperature-retention effect necessary to the stabilization of the ink discharge amount can efficiently be achieved.

Second Embodiment

Figure 7:
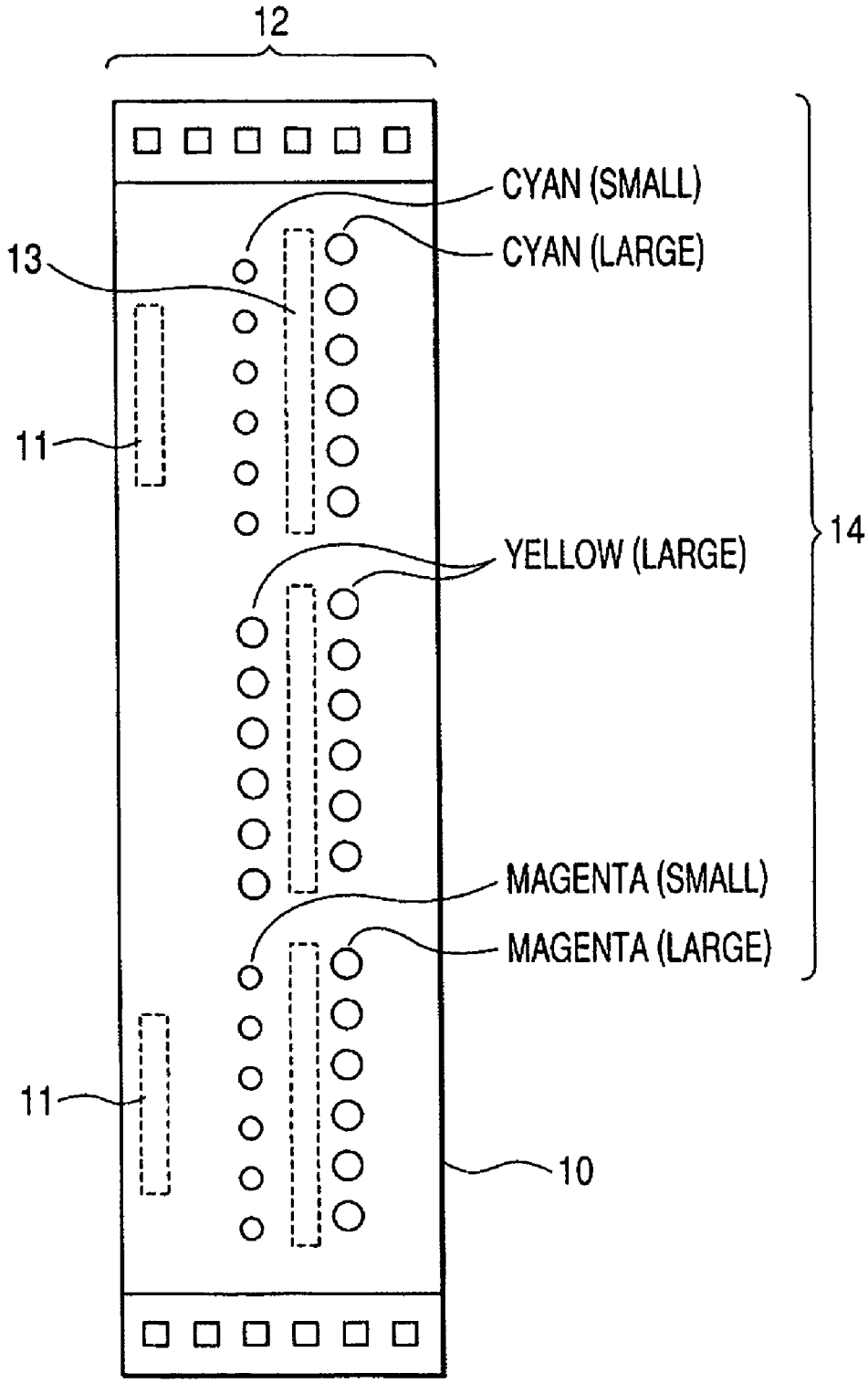
FIG. 7 is a plan view schematically showing a configuration of a second recording element substrate of an ink jet recording head according to a second embodiment of the invention.

FIG. 7 is a plan view explaining the relationship between the nozzle away 14 and the sub-heater 11 of the second color-ink recording element substrate 409 in a second embodiment of the invention. In FIG. 7, the description of the same components as in the first embodiment will be omitted.

In the second embodiment, the three ink supply ports 13 of the cyan color ink, the magenta color ink, and the yellow color ink are formed in series, and the electrothermal conversion elements 50 and the ink discharge ports 15 are formed on the both sides across each of the ink supply port 13. That is, the nozzle arrays 14 (combination of the electrothermal conversion elements 50 and ink discharge ports 15) for the cyan color ink, the magenta color ink, and the yellow color ink are arranged in series.

Specifically, in the recording element substrate 409 of the second embodiment, the two rows of the cyan color ink discharging nozzle arrays 14, the magenta color ink discharging nozzle arrays 14, and the yellow color ink discharging nozzle arrays 14 are arranged in series from one of short sides toward the other short side. That is, as a whole, an apparent one row of nozzle arrays is provided on each of both sides of the row in which the three ink supply ports 13 are arranged in series. The apparent nozzle array is formed by the three nozzle arrays having the different colors.

For the cyan ink discharge portion and the magenta ink discharge portion, the one row of nozzle arrays 14 having the large discharge amount and the one row of nozzle arrays 14 having the small discharge amount are provided across the ink supply port 13 located on each of both side portions (upper and lower portions of FIG. 7) of the second recording element substrate 409. Similarly to the first embodiment, this is because both high image quality and high-speed printing are achieved. On the other hand, for the yellow discharge portion, the two nozzle arrays 14 having the large discharge amounts are provided across the ink supply port 13 in the center portion of the second recording element substrate 409. This is because the ink droplet decreasing effect is small in the yellow color ink.

Similarly to the first embodiment, in the second embodiment, the sub-heaters 11 are arranged near the nozzle away 14 having the small discharge amount (upper left side and lower left side of FIG. 7). Accordingly in the second embodiment, the temperature-retention effect necessary for the stabilization of the ink discharge amount can also efficiently be achieved. Further, the wiring routing for the electrical connection of the sub-heater 11 can easily be performed.

The invention is not limited to the above two embodiments, but the invention can be applied to any ink jet recording head including the nozzle arrays 14 having the different discharge amounts. The number of kinds of the ink used in the image formation and the number of nozzle arrays are not particularly limited. That is, the image formation is not limited to the color of the ink. It is obvious that the invention can be adopted for the ink jet recording head which performs the mono-color image formation. The configuration of the ink jet recording apparatus is not particularly limited. For example, instead of the serial type ink jet recording apparatus, the invention can also be applied to the line type ink jet recording apparatus. In this case, the ink jet recording head is a long-size type head having the width larger than that of the recording area in the recording medium, and the ink jet recording head is, fixed to the ink jet recording apparatus main body.

This application claims priority from Japanese Patent Application No. 2005-040591 filed Feb. 17, 2005, which is hereby incorporated by reference herein.

What is claimed is:

1. An ink jet recording head which discharges ink to perform recording, the ink jet recording head comprising:

a first nozzle array which discharges a predetermined discharge amount of ink;

a plurality of second nozzle arrays which discharge ink having a discharge amount smaller than the predetermined discharge amount of the ink discharged from the first nozzle array; and an element substrate which includes a first heat generating resistance element array and second heat generating resistance element arrays which correspond to the first nozzle away and the second nozzle arrays, and temperature control heaters, wherein each of the temperature control heaters is arranged adjacently to one of the plurality of the second nozzle arrays in a direction perpendicular to the second nozzle arrays and is arranged only in an area between the one of the second nozzle arrays and an end of the element substrate in the perpendicular direction.

2. An ink jet recording head according to claim 1, wherein the element substrate includes an ink supply port between the first nozzle array and one of the second nozzle arrays, the ink supply port supplying the ink to the first nozzle array and the one of the second nozzle arrays, and the temperature control heater is arranged on the same side of the ink supply port as the one of the second nozzle arrays.

3. An ink jet recording head according to claim 1, wherein the second nozzle arrays are provided at outermost positions among the nozzle arrays on the element substrate, and the temperature control heaters are arranged in outer peripheral portions of the element substrate.

4. An ink jet recording apparatus comprising:

the ink jet recording head according to claim 1;

a conveying mechanism which conveys a recording medium;

a carriage which moves the ink jet recording head in a direction intersecting a conveying direction of the recording medium; and a control portion which uses the temperature control heaters to perform temperature control.

* * * * *